United States Patent [19]

Jaffa

[11] Patent Number: 4,893,583

[45] Date of Patent: Jan. 16, 1990

[54] STRETCHER MEANS FOR USE IN A SPIN ART MACHINE

[75] Inventor: David Jaffa, Franklin Lakes, N.J.

[73] Assignee: Artwave America, Inc., Hawthorne, N.J.

[21] Appl. No.: 332,447

[22] Filed: Mar. 31, 1989

Related U.S. Application Data

[63] Continuation of Ser. No. 106,450, Oct. 8, 1987, abandoned.

[51] Int. Cl.[4] ..... B05B 13/02; B05C 11/08

[52] U.S. Cl. ..... 118/52; 118/320; 118/506; 427/240; 434/84

[58] Field of Search ..... 118/52, 320, 500, 506; 427/240; 434/84

[56] References Cited

U.S. PATENT DOCUMENTS

| | | | |
|---|---|---|---|
| 2,557,348 | 6/1951 | Hornbostel | 118/500 X |
| 3,323,491 | 6/1967 | Granick | 118/506 |
| 3,453,991 | 7/1969 | Meth | 118/506 X |
| 4,052,519 | 10/1977 | Prazak, III | 427/240 X |
| 4,550,679 | 11/1985 | Pipa et al. | 118/52 |

*Primary Examiner*—Shrive Beck
*Assistant Examiner*—Alain Bashore
*Attorney, Agent, or Firm*—Hopgood, Calimafde, Kalil, Blaustein & Judlowe

[57] ABSTRACT

For use in spin art decorating, the stretcher is constructed with an expanse of resilient material for supportingly engaging the undersurface of a section of fabric whose outer surface is to receive the liquid coloring agent. The resilient material is suspended by a rectangular rigid frame which is provided with flanges having a series of notches selectably engageable with pins at opposite ends of a carrier arm or beam thereby enabling selection of any one of a number of points for the center of revolution when the frame and article mounted thereon is spun. The stretcher facilitates even application from squeeze bottles of the coloring agents to the garment fabric that is mounted on the stretcher, reduces vibration during spinning, eliminates coloring agent build-up at the geometric center of the stretcher, enhances drying, and yields other advantages.

19 Claims, 3 Drawing Sheets

STRETCHER MEANS FOR USE IN A SPIN ART MACHINE

This application is a continuation of application Ser. No. 106,450 filed Oct. 8, 1987, now abandoned.

BACKGROUND OF THE INVENTION

This invention relates to a device for producing decorative patterns on clothing. More particularly, the invention relates to an improved stretcher structure for use in conjunction with a spinning device for producing individualized designs on clothing such as shirts and other articles by spin art techniques.

In recent years the popularity of individualized clothing has resulted in a market for shirts and other articles of clothing on which the design or pattern has been created by the spin art technique. In this regard, the patentee of the present invention has introduced to the market a device for producing such decorative patterns on clothing. This device which is disclosed and claimed in U.S. Pat. No. 4,550,679, issued to Pipo, et al. which is hereby incorporated by reference, provides apparatus which supports an article of clothing in a flat position while spinning the article at high speed after or during the application of various liquid coloring agents to its surface. In order to support the article of clothing in a flat position, a component referred to as a stretcher is utilized.

As discussed in the above-identified patent, the stretcher is adapted to hold the garment such as a tee shirt in a flat position while preventing bleed through to the side of the garment opposite to that being decorated. The stretcher is provided in various sizes for supporting different size articles of clothing. In use the stretcher is detachably mounted on a stretcher carrier which is adapted to hold the stretcher and associated garment and rotate it around a central axis normal to the plane of the stretcher.

In the past, stretchers have been made of a thin relatively non-porous, pliable material such as cardboard or masonite. While generally satisfactory results have been obtained, the heretofore known stretcher devices have given rise to certain problems. One of the most troublesome of these problems is the build-up of excess coloring agent in the areas located proximate to the geometric center of the stretcher. The accumulation of coloring agents is due to a lack of sufficient centrifugal force to properly "spin off" the coloring agents. The accumulated color agents appear as a thickened layer at that area of the garment located proximate to the geometric center of the stretcher. In addition to detracting from the artistic value of the finished garment, the accumulated deposits of coloring agents gives rise to certain drying problems including prolonged and incomplete drying of the agents.

Furthermore, in order to limit rotational vibration during the spinning process, the stretcher has invariably been positioned so that it is balanced weightwise relative to the central axis of spin. This balanced relationship of the prior art stretcher limits the artistic effects that can be obtained to those that are symmetrical relative to a spin axis that coincides with the geometric center of the stretcher.

Also due to the high speed of rotation of the stretcher, a vacuum is, in some instances, created between the housing of the apparatus and the stretcher which may cause distortion of the stretcher and associated garment. This distortion can affect the free flow of the coloring agents which undermines the effect sought in the art design. It also causes unnecessary air turbulence which, in many instances, causes excess coloring agent to be thrown back onto the garment, thereby causing damage to the design.

Additionally, it has been found that users of the spin technique and associated apparatuses will normally place freshly painted garments into drying ovens without removing the garment from the stretcher. In many instances, depending on the material used for the stretcher, the conditions encountered during the drying process tend to warp the stretcher, eventually rendering it useless for future use. This is particularly true for large sized stretchers in which even a small percentage of warpage may render the stretcher useless. It has also been discovered that due to the bulky and non-porous nature of the stretcher means, drying is often prolonged and incomplete since the stretcher, due to its relatively large mass, acts as a heat sink.

Another serious drawback of prior art stretchers concerns the application of the coloring agents to the garments. As would be understood by one skilled in the art, once the garment to be decorated is positioned on the stretcher it is common for the user to apply the coloring agents directly to the garment using, generally, a squeeze bottle type applicator. It has been discovered that with the garment fitted over a rigid underlying stretcher, the garment tends to be pulled and snagged by the applicator's nozzle, thereby resulting in incomplete or irregular application of the coloring agents. Moreover, due to snagging caused by the underlying stretcher, the cloth to be decorated is, in many instances, subjected to varying degrees of stretch at the point of color application. It is this change in amount of material stretch which has been found to cause uneven opacity of the applied material which severely detracts from the appearance of the completed design. Using direct application by hand it has been found that a smooth even application of the coloring agent is almost impossible to accomplish thereby preventing the artist the full benefit of his artistic expression.

SUMMARY OF THE INVENTION

Accordingly, it is an object of the present invention to provide an improved stretcher which allows for non-symmetrical spin art designs.

Another object of the present invention is to provide an improved stretcher assembly which can eliminate heavy deposits of coloring agents which tend to accumulate proximate to the spin axis.

Another object of the present invention is to provide an improved stretcher assembly which is both light in weight and economical to produce so as to reduce vibration during use.

Still another object of the present invention is to provide an improved stretcher assembly which allows for improved drying of the garment mounted thereon while still providing substantial support to the garment.

Another object of the invention is to provide an improved stretcher assembly which eliminates snagging and pulling of the garment during the application of the coloring agents.

Another object of the invention is to provide an improved stretcher assembly which facilitates the production of consistent opacity of the finished design.

Still other objects and advantages of the present invention will become apparent from the following description of the invention and of the preferred embodiments.

In accordance with one aspect of the present invention, there is provided an improved stretcher for use in a spin art machine in which a rotating carrier member engages the stretcher and spins the stretcher about a spin axis so as to spread over the surface of a fabric mounted on the stretcher, under the action of centrifugal force, a liquid coloring agent that has been applied to said fabric surface, said stretcher comprising in combination an expanse of resilient material, means suspending said resilient material for supportingly engaging the undersurface of a section of fabric whose outer surface is to receive said coloring agent said means including means for maintaining out of engagement with said resilient material any portion of said fabric that extends around and behind said expanse of resilient material, and means for enabling a rotatable carrier member to selectively engage said resilient material suspending means for rotating said stretcher about a plurality of selected spin axes.

BRIEF DESCRIPTION OF THE DRAWINGS

The invention will be better understood after reading the following detailed description of the presently preferred embodiments thereof with reference to the appended drawings in which.

The same reference numerals are used throughout the figures of the drawings to designate the same or similar parts.

DETAILED DESCRIPTION OF THE PRESENTLY PREFERRED EMBODIMENT

Figure 1:
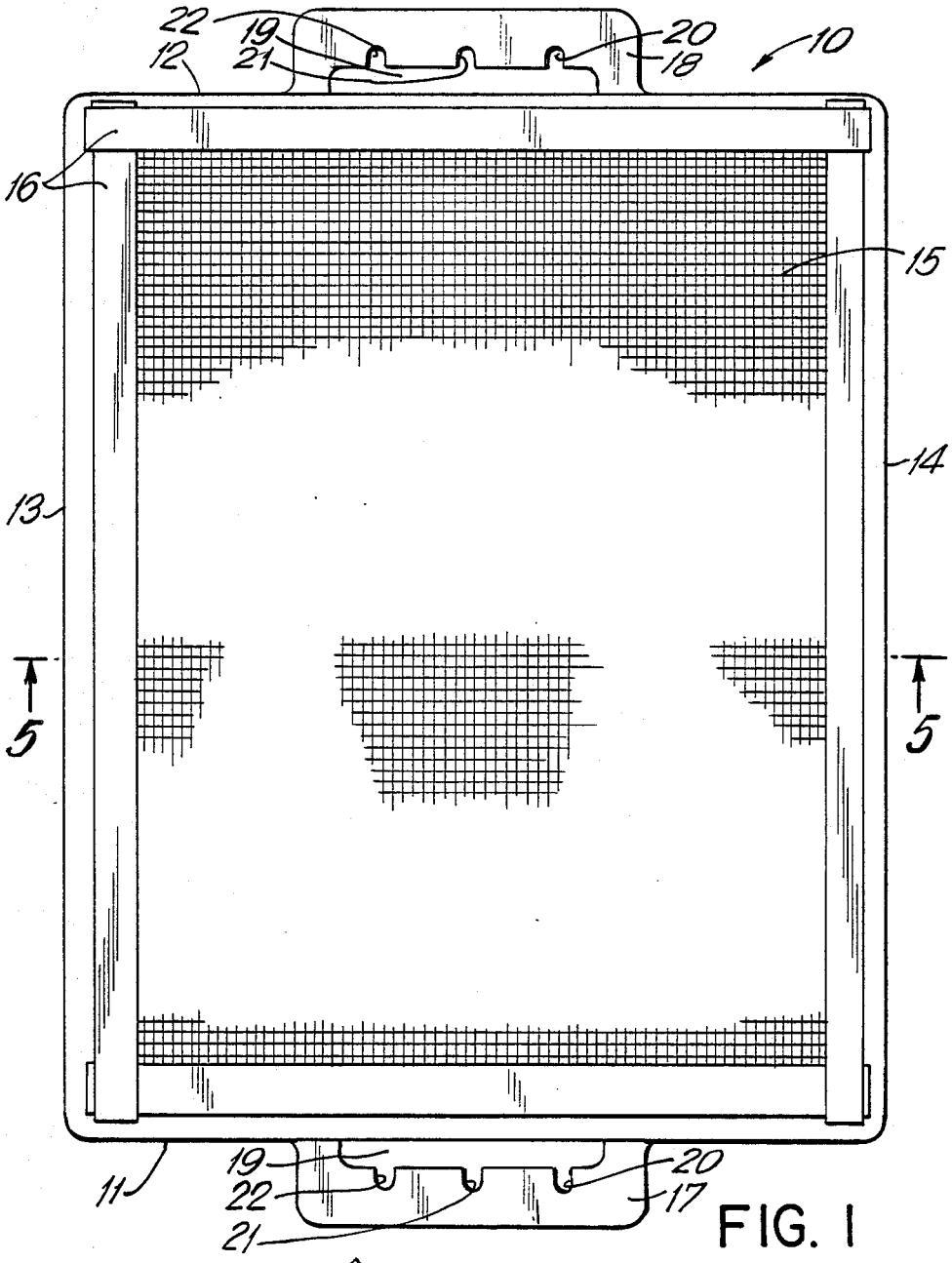
FIG. 1 is a top plan view of a stretcher in accordance with the present invention.

Reference should now be had to the drawings wherein a stretcher embodying the present invention, designated generally by the reference numeral 10, is shown as consisting of a rectangular perimetric frame consisting of opposite short sides 11 and 12 joining opposite long sides 13 and 14. Stretched between the sides of the frame covering the central opening is an expanse of resilient material such as fabric 15 fastened to the top surface of the frame members by means of strips or lengths of adhesive tape 16.

Projecting from opposite short ends of the frame, that is, from the frame members 11 and 12, centered therein, are flanges 17 and 18 each provided with a slot 19 having a series of notches 20, 21 and 22 along the outer margin of the slot.

Figure 3:
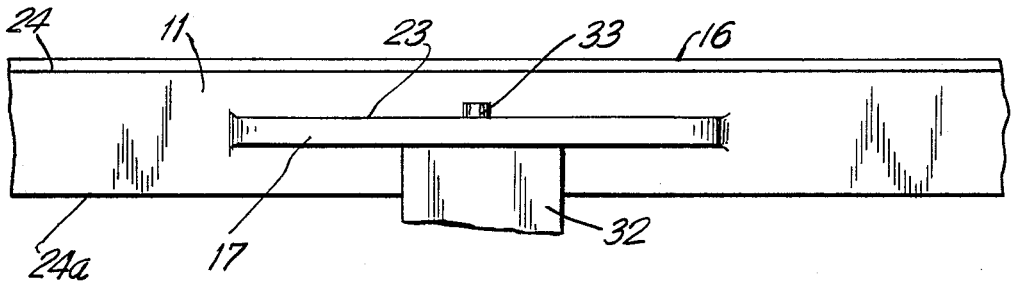
FIG. 3 is an enlarged fragmentary view of the assembly of FIG. 2 as seen in the direction of the arrows 3—3.
Figure 4:
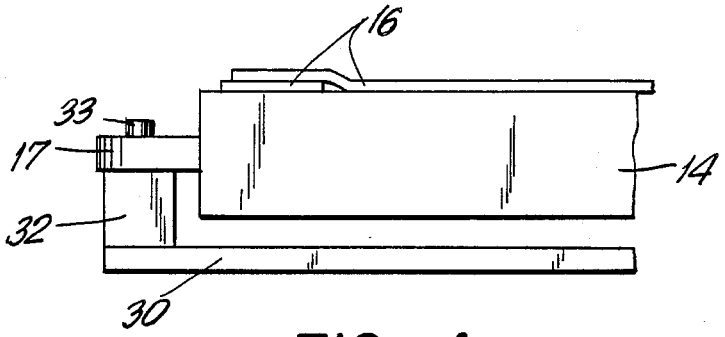
FIG. 4 is an enlarged fragmentary view of the assembly of FIG. 2 as seen in the direction of the arrows 4—4.

Referring to FIG. 3, it should be observed that the flange 17 (the flange 18 is similarly constructed and located) is thinner than the frame member 11 such that the upper surface 23 is displaced or offset below the upper surface 24 of the frame member 11.

Figure 2:
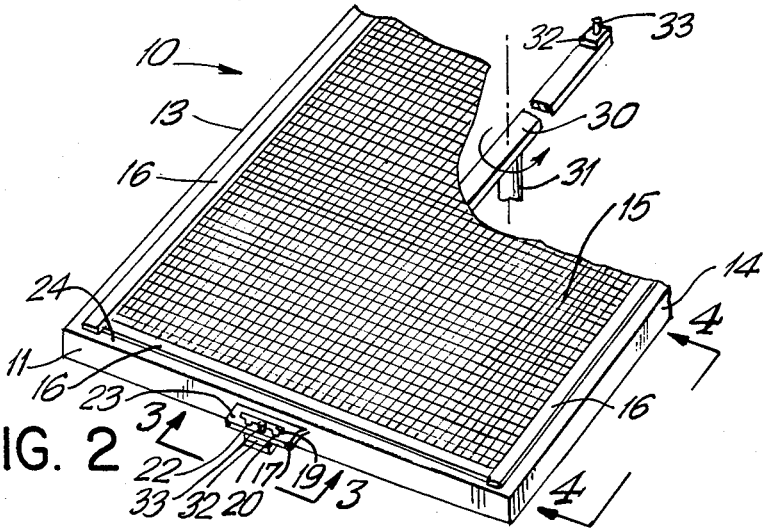
FIG. 2 is a perspective view with portions broken away for clarity of the stretcher of FIG. 1 mounted on a rotatable carrier.

Referring to FIG. 2, it will be seen that the rotatable carrier 30, illustrated only diagrammatically as a bar mounted on a central post or shaft 31, is provided at opposite ends with a pedestal block 32 surmounted by a post or pin 33. Referring to FIG. 1 it should be understood that the notches 21 in the flanges 17 and 18 are aligned at opposite ends of the straight line that coincides with the longitudinal center line of the frame 10. The notches 20 and 22 are, respectively, aligned along lines that are offset to right and left of the center line. As seen in FIG. 2, the frame 10 is mounted on carrier 30 by engaging the respective flanges 17 and 18 over corresponding pins 33 at opposite ends of the carrier 30 with the pins 33 engaged in corresponding notches 20, 21 or 22, as desired. Selection of the particular set of notches will determine the center of rotation of the frame 10 in obvious manner.

The frame consisting of members 11, 12, 13 and 14 should be suitably rigid so as to prevent vibration of the stretcher assembly 10 and avoid distortion thereof. Ideally, the frame 10 should be warp-resistent and light in weight. Additionally, the materials comprising the frame should be nonreactive with and unaffected by chemicals and/or conditions encountered during use in any step of the decorative process. A suitable frame has been constructed of wood, but other materials can be used.

Figure 6:
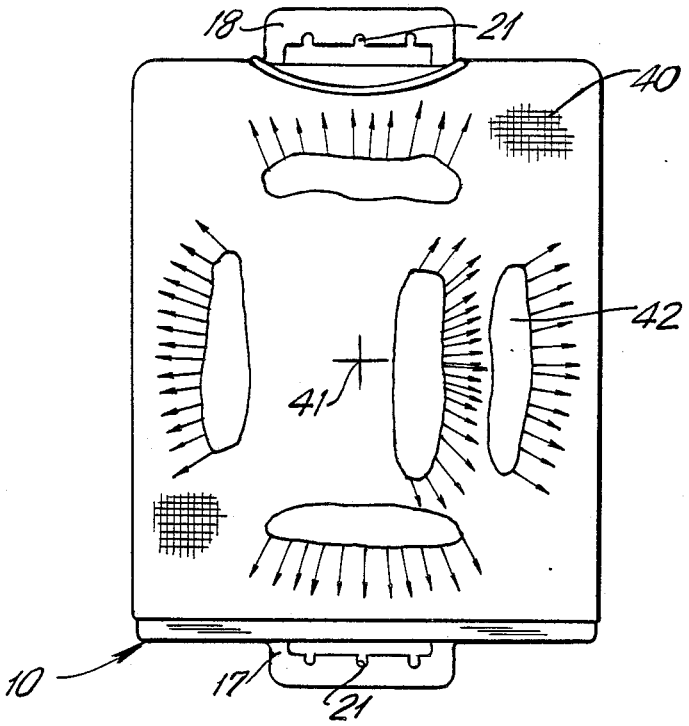
FIG. 6 is a diagrammatic view showing the effect of a centered axis of rotation on the flow of coloring agent applied to a garment mounted on a stretcher of the type shown in FIG. 1.
Figure 7:
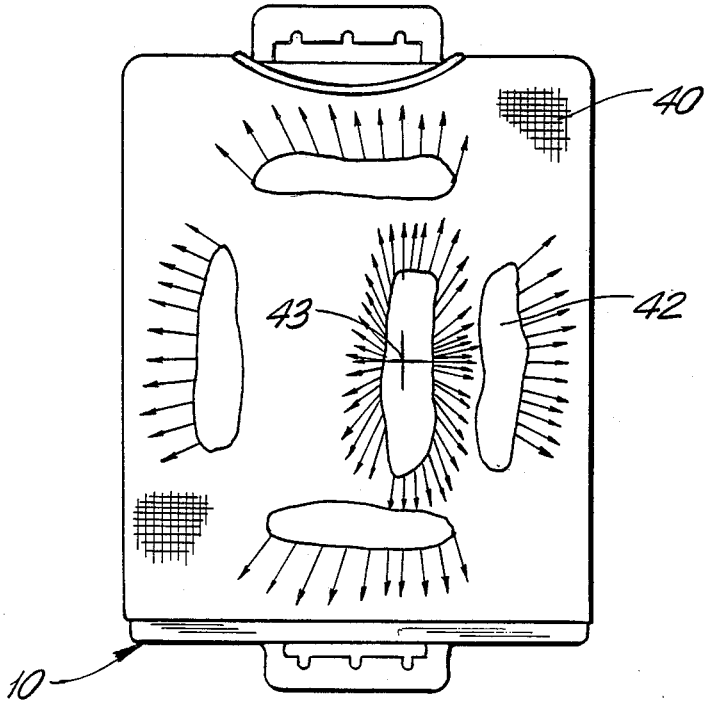
FIG. 7 is a view similar to FIG. 6, showing the effect on the flow of the coloring agent applied to a garment when the axis of rotation is offset from the center.
Figure 5:
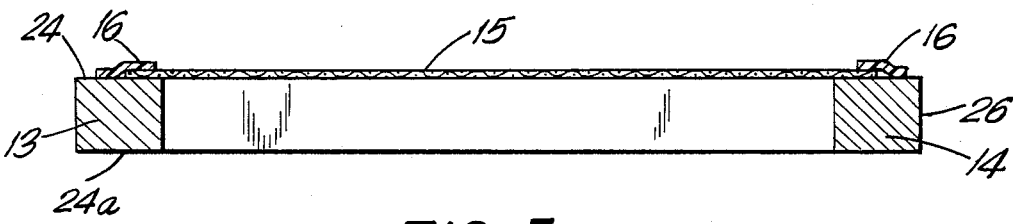
FIG. 5 is a sectional view taken along the line 5—5 in FIG. 1.

As illustrated diagrammatically in FIGS. 6 and 7, the garment in the form of a tee shirt 40 has been mounted on the frame 10 with the frame sized to place the shirt under slight tension. If the frame should not be large enough to accomplish this it is necessary to use pins or other fasteners on the underside of the frame to pull the fabric of the shirt taut in order that the fabric on the exposed upper surface of the frame will be under slight tension. As best seen in FIG. 5, the outboard upper edges 26 around the entire frame should be relatively sharp and not noticeably rounded. This is to facilitate stretching the fabric tightly over such edges. Tight stretching of the garment fabric over the edges 26 prevents coloring material or agents from bleeding over the frame face thereby ensuring the creation of sharply defined borders on fabric that is being decorated. It is for this particular reason that the flange members 17 and 18 should be located below the upper surface 24 of the frame in order that there is no interruption to the continuous sharp edge around the rectangle. In this regard, although flange members 17 and 18 are depicted as being midway between the upper surface 24 and lower surface **24*a* of frame number 11, it should be understood that flanges 17 and 18 may be displaced or offset any distance below the upper surface of frame members 11 and 12**, including being mounted directly to the lower surface of said member so as to extend outwardly.

FIGS. 6 and 7 illustrate the variation in effect that can be achieved depending upon the selection of the notches 20, 21 or 22 for mounting on the carrier 30. In FIG. 6, the notches 21 were used locating the spin center at the point 41 at the geometric center of the frame. The areas designated by the numerals 42 represent quantities of coloring agent applied to the surface of the fabric. The array of arrows surrounding the various coloring agent zones 42 are intended to indicate the relative spreading of the coloring agent under the action of the centrifugal forces that develop when the frame is spun about the center 41. Comparing FIG. 6 with FIG. 7 where the center of rotation is now located at point 43 by utilizing notches 22 for supporting the frame, one can perceive the different resulting effect.

It should be apparent that the rectangular frame, consisting of members 11, 12, 13 and 14 which extend on one side of the expanse of resilient material 15, will function to maintain the fabric of the garment, that extends around and behind the frame and the resilient material 15, out of engagement with such resilient material such that if any of the coloring agent should bleed through the fabric that is in contact with the material 15 it will not transfer through to the opposite side of the garment.

In order to achieve all of the objects set forth above, the material 15 should be flexible and resilient. In addition, the material may be porous which will aid drying of the decorated garment. Considering the material 15 as having "pores" it is not essential that such pore structure have any particular uniformity. Thus the material 15, from the standpoint of pore structure can be either isotropic or anisotropic. The material of the structure 15 should be nonreactive with any of the coloring agents used in the decorating process. Such coloring agents include, for example, inks, paints, dyes and any of the solvents therefor. Additionally, the material 15 should be able to withstand the degree of heat normally used to dry the coloring agents on the fabric.

The material used to construct the element 15 is preferably non-metallic and may be a non-porous or porous material including woven fabric, all produced from either natural or synthetic materials.

The resilient material 15 performs two basic functions. On the one hand it has been unexpectedly found that when the stretcher of the Present invention is used the decorative coloring agents can be applied easily and smoothly without snagging or pulling the garment. Although it is not completely understood why the improved result is obtained, it is suggested that the resilient or flexible backing functions to smooth out the contact pressure between the squeeze bottle nozzle and fabric thereby giving rise to more uniform gliding friction as the nozzle traverses the material and permitting more uniform applicator velocity and better control of the rate of application of the coloring agent. Also, with more uniform contact friction, the stretching of the fabric at the point of coloring agent application is not disturbed as much as heretofore giving rise to more uniform absorption and more consistent opacity of the coloring agent. On the other hand, since element 15 is preferably a thin and light weight material, less heat is lost to it during the drying process. Moreover, when element 15 is constructed of a porous material, air is allowed to circulate therethrough during the spinning and drying process thereby decreasing turbulence and further improving drying. Of course, the advantages of permitting air to flow through the material 15 can be achieved with any foraminous sheet, in which case the material 15 may be metallic. However, the lack of resilience or flexibility will detract from the smoothing effect obtainable with a non-metallic woven fabric or the like. Other considerations in determining the material to use for the component 15 is that while smaller pore size or tighter mesh will tend to prevent passage of coloring agent therethrough, it also will impede the flow of air therethrough. Therefore, a suitable compromise should be obtained bearing in mind the viscosity of the ink, dye or other coloring agent that will be used. The resilient material 15 can be made thin and light in weight and thus permit the construction of a stretcher of much less weight or mass than previously known. Because of the reduction in mass, there is a reduction in thermal inertia when the frame is included in the drying oven.

To summarize, the offset design of the present invention allows for non-symmetrical spinning of the work piece thereby allowing for greater flexibility in the spin art designs. Moreover, the non-symmetrical spinning of the present stretcher provides for the elimination of heavy deposits of coloring agents which tend to accumulate proximate to the spin axis when using stretchers heretofore available. Additionally, the flexible and resilient material layer 15 permits more uniform application of coloring agents on the fabrics that are mounted thereon by eliminating the problem of pulling and snagging of the squeeze bottle applicator on the surface of the fabric. The material 15 acts as a shock absorber during the application of the coloring agent thereby promoting a continuous and smooth interaction between the squeeze bottle applicator tip and the fabric. Changes in the downward pressure of the applicator tip are absorbed by the resilient material. The color applicator does not snag and bounce over the material and it enables more positive control over the consistency and degree of opacity of the design. Moreover, when a porous material is used, the free passage of air through the pores of the fabric or material 15 prevents the formation of a vacuum on either side of the stretcher 10 thereby eliminating the problem of distortion of the stretcher assembly and promoting the unimpeded flow of the coloring agents. Furthermore, undesirable turbulence and vibration are eliminated as the stretcher rotates.

While the invention has been described above with reference to a particular flange and notch arrangement for mounting the frame 10 on the carrier 30, it should be understood that the mounting arrangement may take variable form. The notches 20, 21, and 22 may be isolated, one from the other and not interconnected by a continuous slot 19. Alternatively, individual ears or eyes may be located at various points along the side of the frame 10 to be selectively engaged over the pins 33 of the carrier 30. The mounting means can be located along the long sides of the rectangle as well as or as an alternative to the flanges on the short side. Any other suitable arrangement for selectively mounting the frame off center on a spin carrier can be utilized. Moreover, although the invention has been described with reference to the resilient support material in combination with the unique off-center mounting, it is understood that each of these concepts may be used individually in combination with prior art stretcher designs.

While the specific described example employs strips of adhesive tape to secure the material 15 to the frame members 11, 12, 13 and 14, this is only presented as an example. The material 15 may be united by any suitable adhesive to the frame members or it may be joined to the frame members by splines or in any other suitable manner. Preferably, however, the means of securing the material 15 to the frame members should be amenable to ready replacement of the material 15 if it should be damaged in any way.

While the invention has been described with reference to the presently preferred embodiment thereof, it should be apparent to those skilled in the art that various modifications and changes in construction can be incorporated without departing from the true spirit of the invention as defined in the appended claims.

What is claimed is:

1. A stretcher for use in a spin art machine in which a rotating carrier member engages the stretcher and spins the stretcher about a spin axis so as to spread over the surface of a fabric mounted on the stretcher, under the action of centrifugal force, a liquid coloring agent that has been applied to said fabric surface, said stretcher comprising in combination:

an expanse of resilient material adapted to absorb pressure applied at the point of application of the coloring agent, thereby promoting smooth, continuous application thereof;

means suspending said resilient material for supportingly engaging the undersurface of a section of said fabric whose outer surface is to receive said coloring agent, said means including means for maintaining out of engagement with said resilient material any portion of said fabric that extends around and behind said expense of material, said suspending means comprising a perimetric frame suspending said resilient material substantially in a plane; and means for enabling a rotatable carrier to engage said resilient material suspending means at opposite ends thereof along a selectable one of a group of parallel straight lines so that said stretcher may be spun about a selectable axis normal to the plane of said resilient material, said axis passing through the mid-point of the selected line.

2. A stretcher according to claim 1, wherein said resilient material is porous.

3. A stretcher according to claim 2, wherein said porous material comprises a fabric structure.

4. A stretcher according to claim 2, wherein said porous material comprises a mesh structure.

5. A stretcher according to claim 3, wherein said porous material comprises a non-metallic woven fabric.

6. A stretcher according to claim 5, wherein said woven fabric comprises threads of synthetic material.

7. A stretcher according to claim 5, wherein said perimetric frame suspending said porous material in a plane extends substantially perpendicularly away from said plane on one side of said porous material.

8. A stretcher according to claim 7, wherein said frame is rectangular with opposite short sides joining opposite long sides, and wherein said means for enabling said rotatable carrier member to engage said expense of resilient material are disposed substantially centered in each of said short sides extending outwardly of said frame generally parallel to said plane.

9. A stretcher according to claim 1, wherein said resilient material suspending means comprises a perimetric frame suspending said resilient material substantially in a plane, said frame extending substantially perpendicularly away from said plane on one side of said porous material.

10. A stretcher according to claim 9, wherein said frame is rectangular with opposite short sides joining opposite long sides, and wherein said means for enabling said rotatable carrier member to engage said expanse of resilient material are disposed substantially centered in each of said short sides extending outwardly of said frame generally parallel to said plane.

11. A stretcher for use in a spin art machine in which a rotating carrier member engages the stretcher and spins the stretcher about a spin axis so as to spread over the surface of fabric mounted on the stretcher, under the action of centrifugal force, a liquid coloring agent that has been applied to said fabric surface, said stretcher comprising:

a support surface for supportingly engaging the undersurface of a section of said fabric whose outer surface is to receive said coloring agent, said support surface adapted to absorb pressure applied at the point of application of coloring agent, thereby promoting smooth and continuous application thereof; and means for enabling a rotatable carrier to engage said support surface at opposite ends thereof along a selectable one of a group of parallel straight lines so that said support surface may be spun about a selectable axis normal to the plane of said support surface, said axis passing through the mid-point of the selected line, said means including a perimetric frame for said support surface.

12. A stretcher for use in a spin art machine in which a rotating carrier member engages the stretcher and spins the stretcher about a spin axis so as to spread over the surface of a fabric mounted on the stretcher, under the action of centrifugal force, a liquid coloring agent that has been applied to said fabric surface, said stretcher comprising in combination.

an expanse of resilient material, means suspending said resilient material for supportingly engaging the undersurface of a section of said fabric whose outer surface is to receive said coloring agent, said means including means for maintaining out of engagement with said resilient material any portion of said fabric that extends around and behind said expense of material, said suspending means including a perimetric frame suspending said resilient material substantially in a plane, and means for enabling a rotatable carrier member to engage said resilient material suspending means for rotating said stretcher about a spin axis, said resilient material adapted to absorb pressure applied at the point of application of said coloring agent to said fabric, thereby promoting smooth, continuous application thereof.

13. A stretcher according to claim 12, wherein said resilient material comprises a mesh structure.

14. A stretcher according to claim 13 wherein said resilient material comprises a fabric structure.

15. A stretcher according to claim 14 wherein said resilient material comprises a non-metallic woven fabric.

16. A stretcher according to claim 15, wherein said woven fabric comprises threads of synthetic material.

17. A stretcher according to claim 15, wherein said perimetric frame suspending said resilient material substantially in a plane extends substantially perpendicularly away from said plane of said resilient material.

18. A stretcher according to claim 17, wherein said frame is rectangular with opposite short sides joining opposite long sides, and mounting means are disposed substantially centered in each of said short sides extending outwardly of said frame generally parallel to said plane.

19. A stretcher according to claim 18, wherein said mounting means includes means for engaging said frame at opposite ends thereof along a selectable one of a group of parallel straight lines so that said frame may be spun about a selectable axis normal to said plane and passing through the mid-point of the selected line.

* * * * *

UNITED STATES PATENT AND TRADEMARK OFFICE

CERTIFICATE OF CORRECTION

PATENT NO. : 4,893,583

DATED : January 16, 1990

INVENTOR(S) : David Jaffa

It is certified that error appears in the above-identified patent and that said Letters Patent is hereby corrected as shown below:

Column 8, claim 12, line 15 of the claim, change "expense" to --expanse--

Signed and Sealed this

Fourth Day of December, 1990

*Attest:*

*Attesting Officer*

HARRY F. MANBECK, JR.

*Commissioner of Patents and Trademarks*